US005940905A

United States Patent [19]

Cheng

[11] Patent Number: 5,940,905

[45] Date of Patent: Aug. 24, 1999

[54] BATHING CHAIR POSITIONING SYSTEM

[76] Inventor: Yu-Wen Cheng, 5F, No. 46, Shuang-Chuan Street, Pei Tou, Taipei, Taiwan

[21] Appl. No.: 09/132,840

[22] Filed: Aug. 12, 1998

[51] Int. Cl.[6] ..... A47K 3/022

[52] U.S. Cl. ..... 4/578.1; 4/560.1; 4/579; 4/571.1

[58] Field of Search ..... 4/578.1, 560.1, 4/562.1, 590, 589, 571.1, 579; 297/215.13, 215.14, 344.11; 248/429, 430; 5/81.1 HS

[56] References Cited

U.S. PATENT DOCUMENTS

| | | | |
|---|---|---|---|
| 2,903,047 | 9/1959 | Funyak . | |
| 4,359,791 | 11/1982 | Thomas | 4/579 |
| 5,558,022 | 9/1996 | Mason et al. | 4/578.1 |
| 5,561,868 | 10/1996 | Campbell | 4/578.1 |
| 5,822,809 | 10/1998 | Gallo | 4/578.1 |

FOREIGN PATENT DOCUMENTS

| | | | |
|---|---|---|---|
| 1058207 | 3/1959 | Sweden | 5/81.1 HS |

*Primary Examiner*—Henry J. Recla
*Assistant Examiner*—Khoa Huynh
*Attorney, Agent, or Firm*—Pro-Techtor International Services

[57] ABSTRACT

A bathing chair positioning system for use on a bathing chair. The bathing chair has a frame with two parallel transverse bars shaped like inverted letters U and with ends that are placed inside and outside a bathtub, two connecting bars, connecting the two transverse bars, a seat with a bottom and a back rest, with two parallel L-shaped bars connecting the bottom and the back rest and mounted on gliding elements, such that the seat is glidingly movable along the two transverse bars for a user to enter and to leave the bathtub, and a handle for the user pulling herself or himself into the bathtub or out of the bathtub. The bathing chair positioning system comprises positioning elements having fixed ends fastened to the L-shaped bars of the seat and blocking ends extending away from the seat and engaging with the connecting bars when the seat is at an outside position for the user safely entering and leaving the seat or at a bathing position.

4 Claims, 3 Drawing Sheets

BATHING CHAIR POSITIONING SYSTEM

BACKGROUND OF THE INVENTION

1. Field of the Invention

The present invention relates to a bathing chair positioning system, particularly to a bathing chair positioning system, which has a horizontally movable seat to be positioned inside or outside a bathtub.

2. Description of Related Art

Conventional bathtubs in a bathroom are inconvenient for old persons or persons disabled at the lower part of the body, because it is difficult for them to step over the edge of the bathtub. Generally a nurse is needed for assistance. To make entering and leaving a bathtub easier and less dangerous for old or disabled persons bathtub seats have been designed. A bathtub seat extends over the width of the bathtub. When entering the bathtub, the user sits down on the seat and slides towards the middle of the bathtub seat. The nurse only has to help to place the legs of the user in the bathtub, and the user may bathe. For leaving the bathtub, the legs of the user are heaved over the edge of the bathtub, and the user slides outward. However, shifting the bottom while holding grips with the hands is a hard task for old and disabled persons. Having the legs lifted at the same time by the nurse easily results in balance being lost. Therefore, conventional bathtub seats are not convenient and not safe to use. A nurse is still needed for assistance.

For this reason, a nursing chair has been designed to assist an old or disabled user effectively for entering and leaving a bathtub. As shown in FIG. 3 the nursing chair comprises: a frame 2, which extends over the width of the bathtub and a longitudinal edge thereof; several gliding elements 3, glidingly movable along the frame 2; a seat 4, which is fastened to the gliding elements 3; and a handle 5. The frame comprises two transverse bars 21, 22, which are bent into the shape of a wide letter U turned upside down, and two connecting bars 23A, 23B for connecting the transverse bars 21 and 22. The two bars 21, 22 are parallel to each other and extend over the longitudinal edge of the bathtub. The transverse bars 21, 22 have a horizontal middle sections 211, 221, respectively. The seat 4 has a bottom and a back rest 41. The back rest 41 is connected to the bottom 41 by L-shaped bars 42A, 42B. The seat 4 is fastened to the gliding elements 3 by bolts and thus glidingly movable along the horizontal middle sections 211, 221 of the transverse bars 21, 22. The handle 5 is shaped like the letter U turned upside down and connects the transverse bars 21, 22 on neighboring ends of the horizontal middle sections 211, 221 thereof at a suitable height. The user, in order to enter the bathtub, sits down on the seat 4 in a position outside the bathtub 1 and then glides into the bathtub 1, holding the handle 5.

This nursing chair allows an old or disabled person to enter and leave a bathtub safely, but still has the following shortcoming. When the user gets seated or is busy bathing, the seat possibly glides aside, leaving the user with an insecure feeling or even causing the user to lose balance.

SUMMARY OF THE INVENTION

It is therefore the object of the present invention to provide a bathing chair positioning system which prevents a bathing chair from unintentionally gliding aside when getting seated or during bathing.

The present invention can be more fully understood by reference to the following description and accompanying drawings.

DETAILED DESCRIPTION OF THE PREFERRED EMBODIMENT

Figure 3:
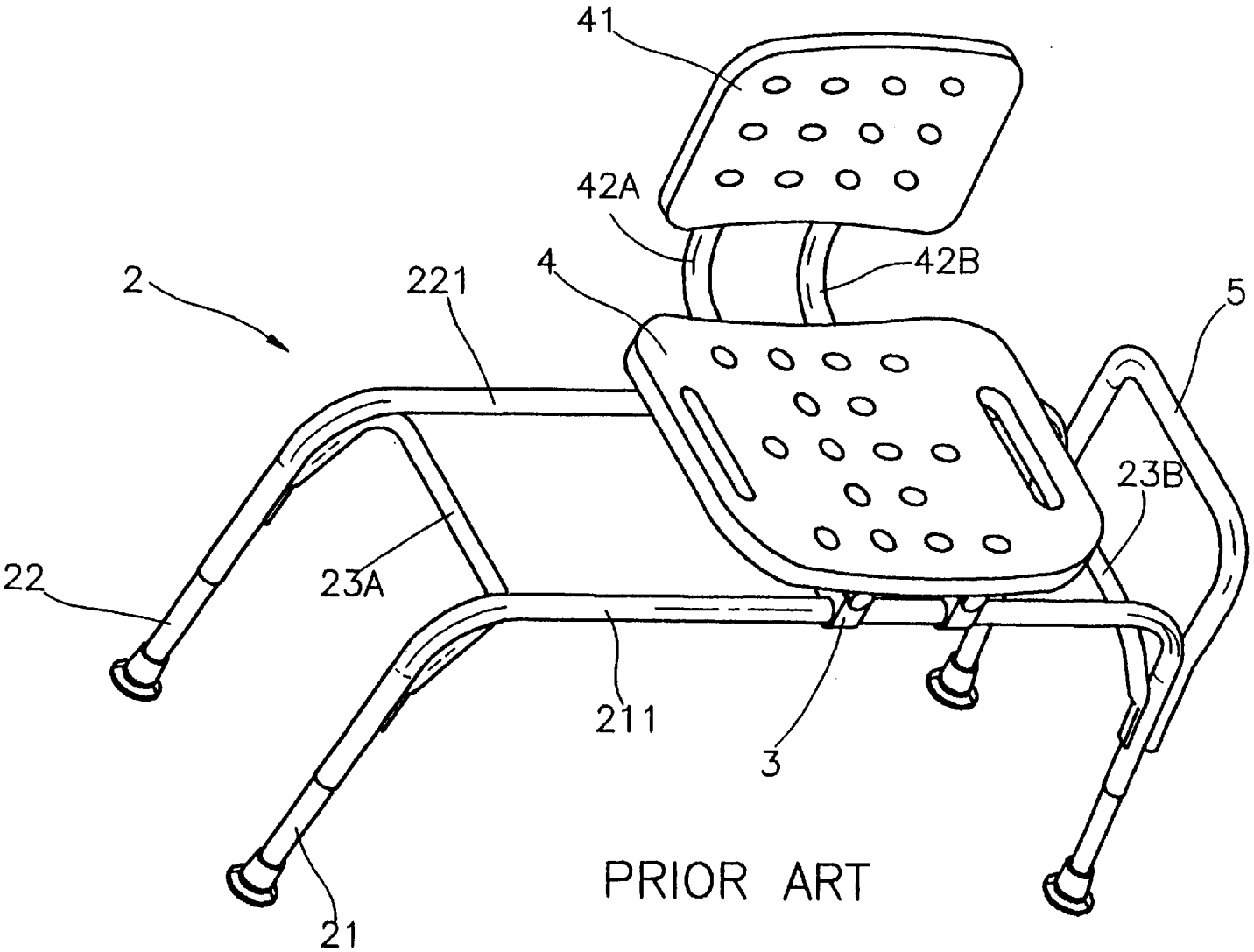
PRIOR ART FIG. 3
FIG. 3 is a perspective view of a conventional bathing chair.

The bathing chair positioning system of the present invention is used on a bathing chair as illustrated in FIG. 3 and described above, fixing the relative positions of the connecting bars 23A, 23B and the L-shaped bars 42A, 42B of the bathing chair. In the following, the L-shaped bar 42A and the connecting bar 23A are taken as an example for mounting the present invention.

The bathing chair positioning system of the present invention has a positioning element 6. The positioning element 6 is an elongated body, having a fixed end 61 and an opposite blocking end 66 and a lower side, as defined by mounting on the bathing chair. The fixed end 61 is fastened to the L-shaped bar 42A on the lower side thereof, with a fastening element 63 connected to the L-shaped bar 42A. The blocking end 66 engages with the connecting bar 23A when needed for preventing the seat 4 from moving on the frame 2 of the bathing chair.

The positioning elements 6 are made of flexible material, like plastics. The blocking end 66 has a tip 68 and a blocking element 67 on the lower side, which is bent downwards. Before sitting down on the bathing chair, the user pulls the seat 4 towards the connecting bar 23A, until the blocking element 67 engages with the connecting bar 23A. When safely seated, the user pulls up the blocking end 66, having the blocking element 67 disengaged from the connecting bar 23A and allowing the seat 4 to glide on the frame 2.

Figure 1:
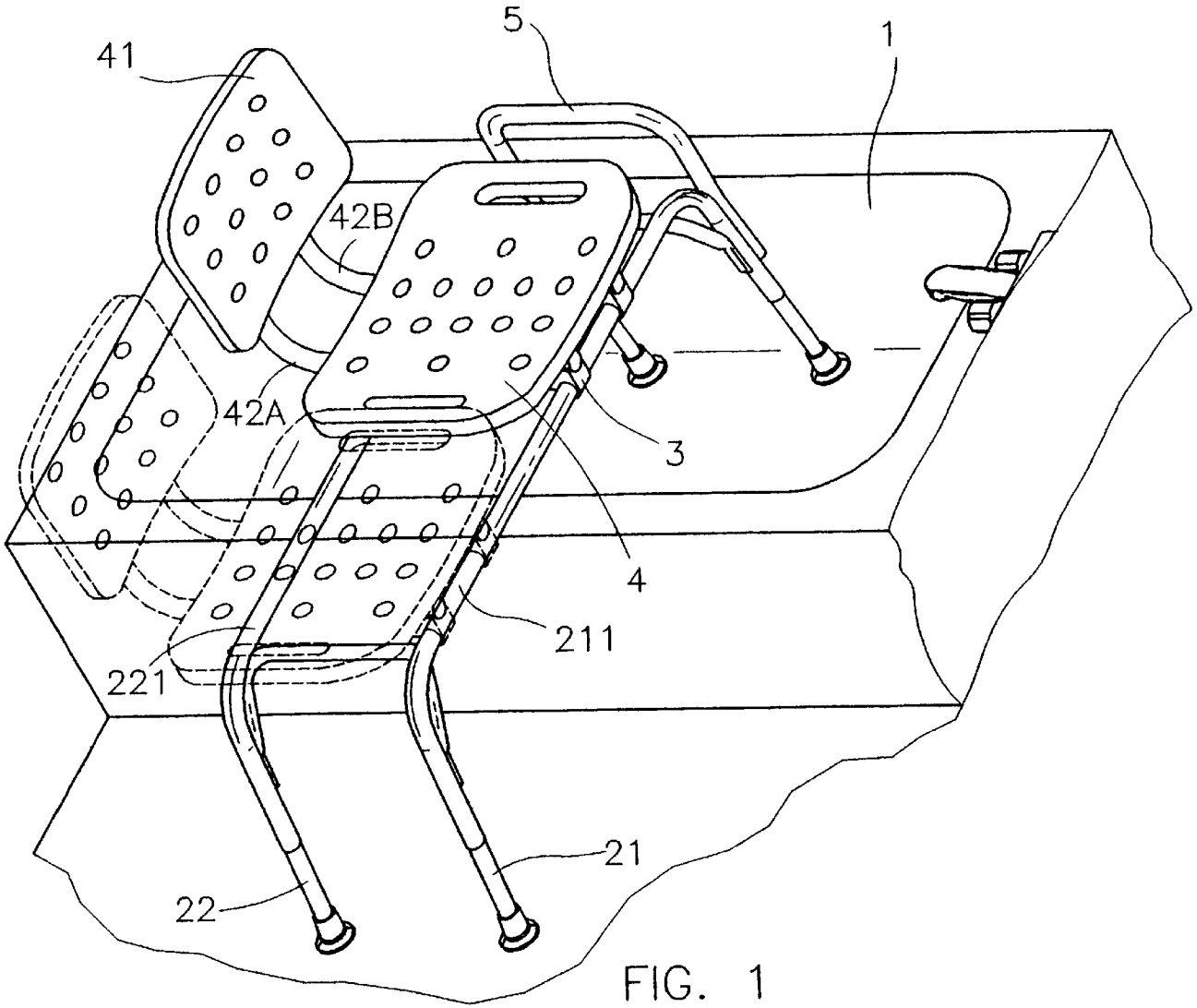
FIG. 1 is a schematic illustration of the use of the present invention in conjunction with a bathing chair.
Figure 2:
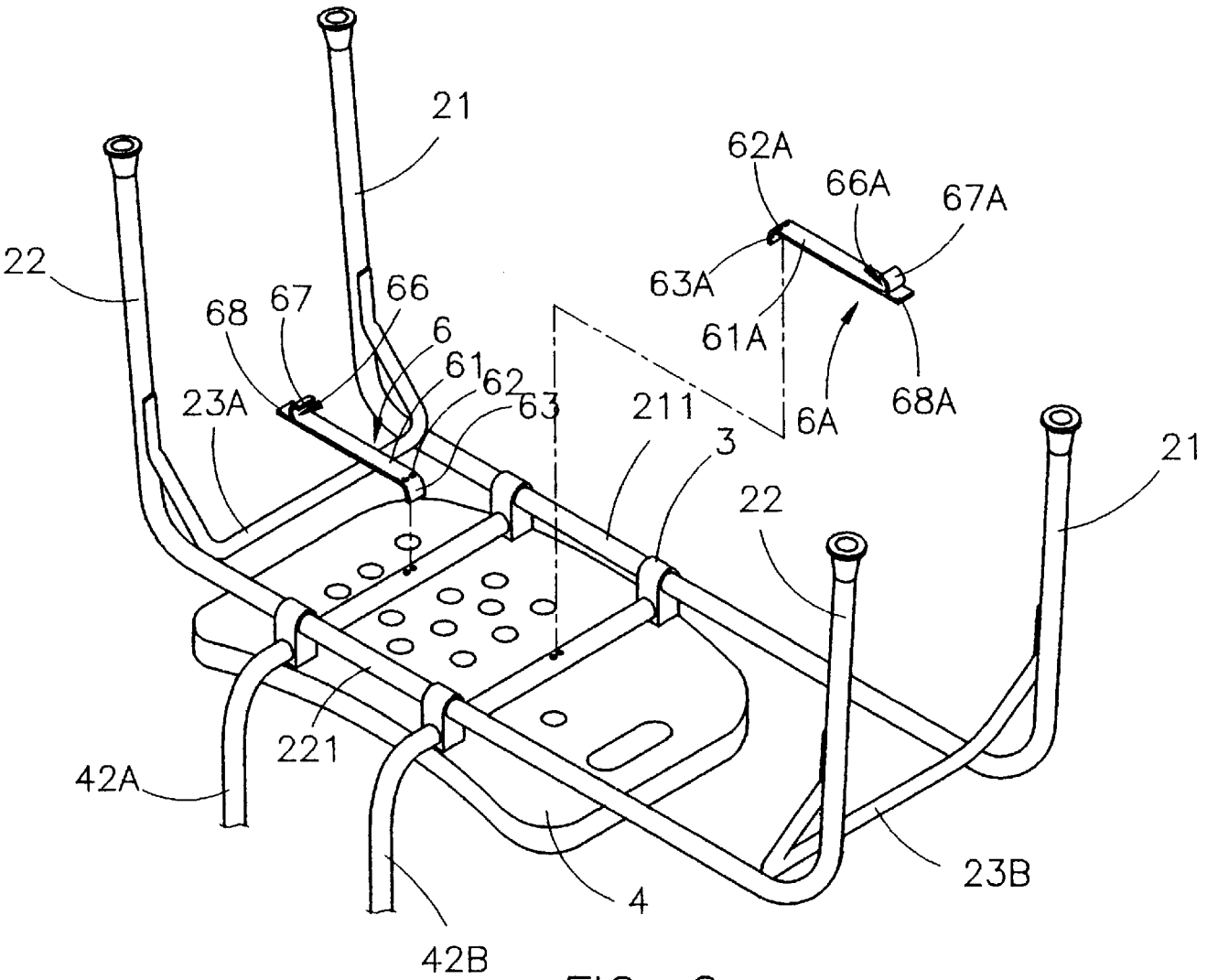
FIG. 2 is a schematic illustration of the assembly of the present invention on a bathing chair.

The shapes of the fastening element 63 and the blocking element 67 are adapted to the cross-sections of the L-shaped bar 42A and the connecting bar 23A. As shown in FIGS. 1 and 2, the fastening element 63 and the blocking element 67 preferably are shaped like arcs.

The present invention also has a positioning element 6A for fixing the relative positions of the L-shaped bar 42B and the connecting bar 23B. Like the positioning element 6, the positioning element 6A is an elongated body, having a fixed end 61A and an opposite blocking end 66A. The fixed end 61A is fastened to the L-shaped bar 42B on the lower side thereof, with a fastening element 63A connected to the L-shaped bar 42B. The blocking end 66A has a blocking element 67A for engaging with the connecting bar 23B. For leaving the bathtub, the user pulls up the blocking end 66A, having the blocking element 67A disengaged from the connecting bar 23B and allowing the seat 4 to glide on the frame 2.

While the invention has been described with reference to preferred embodiments thereof, it is to be understood that modifications or variations may be easily made without departing from the spirit of this invention which is defined by the appended claims.

I claim:

1. A bathing chair positioning system to be used on a bathing chair having a frame, which has two parallel transverse bars shaped like inverted letters U and with ends that are placed inside and outside a bathtub, two connecting bars, connecting said two transverse bars, several gliding elements, which are glidingly movable along said two transverse bars, a seat, having a bottom and a back rest, with two parallel L-shaped bars connecting said bottom and said back rest and mounted on said gliding elements, such that said seat is glidingly movable along said two transverse bars for a user to enter and to leave said bathtub, and a handle, which is shaped like the inverted letter U and fastened to said two transverse bars at a suitable height for said user pulling herself or himself into said bathtub and pushing herself or himself out of said bathtub, said bathing chair positioning system comprising a first positioning element having a first fixed end fastened to one of said L-shaped bars of said seat and a first blocking end extending away from said seat, with said first blocking end engaging with one of said connecting bars when said seat is at an outside position for said user safely entering and leaving said seat.

2. A bathing chair positioning system according to claim 1, further comprising a second positioning element having a second fixed end and a second blocking end engaging with one of said connecting bars when said seat is at a bathing position.

3. A bathing chair positioning system according to claim 1, wherein said first blocking end has a shape that fits to said connecting bars.

4. A bathing chair positioning system according to claim 1, wherein said fixed ends have fixing elements.

* * * * *